US010569128B2

(12) United States Patent
Hirschinger

(10) Patent No.: US 10,569,128 B2
(45) Date of Patent: Feb. 25, 2020

(54) THERAPEUTIC STRETCHING DEVICE FOR THE JAW AND SURROUNDING MUSCULATURE

(71) Applicant: Gentle Jaw Holding Company, Beverly Hills, CA (US)

(72) Inventor: Rich Hirschinger, Beverly Hills, CA (US)

(73) Assignee: Gentle Jaw Holding Company, Beverly Hills, CA (US)

( * ) Notice: Subject to any disclaimer, the term of this patent is extended or adjusted under 35 U.S.C. 154(b) by 11 days.

(21) Appl. No.: 15/686,425

(22) Filed: Aug. 25, 2017

(65) Prior Publication Data

US 2018/0056121 A1 Mar. 1, 2018

Related U.S. Application Data

(60) Provisional application No. 62/380,366, filed on Aug. 27, 2016, provisional application No. 62/380,624, filed on Aug. 29, 2016.

(51) Int. Cl.

| | |
|---|---|
| ***A63B 23/03*** | (2006.01) |
| *A63B 23/00* | (2006.01) |
| *A63B 21/00* | (2006.01) |
| *A63B 23/025* | (2006.01) |

(52) U.S. Cl.

CPC ..... *A63B 23/032* (2013.01); *A63B 21/4003* (2015.10); *A63B 21/4039* (2015.10); *A63B 23/025* (2013.01); *A63B 23/03* (2013.01); *A63B 2023/006* (2013.01); *A63B 2225/09* (2013.01); *A63B 2225/50* (2013.01)

(58) Field of Classification Search

CPC ..... A63B 23/032; A63B 23/025; A63B 23/03; A63B 2023/006; A63B 21/00178; A63B 21/4003; A63B 21/4039

See application file for complete search history.

(56) References Cited

U.S. PATENT DOCUMENTS

| | | | | |
|---|---|---|---|---|
| 4,909,502 | A * | 3/1990 | Beeuwkes, III | A61H 1/02 482/11 |
| 5,746,703 | A * | 5/1998 | Levatino | A63B 21/0552 482/11 |
| 8,105,210 | B2 * | 1/2012 | Seybold | A63B 23/032 128/861 |
| 10,029,144 | B2 * | 7/2018 | Noguchi | A61H 23/004 |
| 2007/0089752 | A1 * | 4/2007 | Christensen, III | A61H 1/0218 128/845 |
| 2012/0208677 | A1 * | 8/2012 | Lally | A63B 23/032 482/11 |

OTHER PUBLICATIONS https://web.archive.org/web/20130901000000*/http://www.medicalimagingsuppliesusa.com/product/tmj-wedge-box-of-24/ archived: Oct. 12, 2013; retrieved: Apr. 12, 2019 (Year: 2013).*

* cited by examiner

*Primary Examiner* — Megan Anderson

(57) ABSTRACT

A wedge-shaped therapeutic stretching device for the jaw generally having three sides (first, second and third), the three sides connected to each other to create the wedge shape. At the corner of two of the three sides is a stop that can rest on a user's lower teeth. On an opposing side of the stop is the second side of the stretching device, on which a plurality of steps is formed. A user's upper teeth can be placed on one of the steps. As the user's jaw flexibility increases, a user can move "up" in steps, thereby increasing distance between upper/lower jaw and allowing the jaw to stretch providing therapeutic relief.

10 Claims, 15 Drawing Sheets

THERAPEUTIC STRETCHING DEVICE FOR THE JAW AND SURROUNDING MUSCULATURE

CROSS-REFERENCE TO RELATED APPLICATIONS

This application claims priority to U.S. Provisional Application No. 62/380,366 filed on Aug. 27, 2016, and U.S. Provisional Application No. 62/380,624 filed on Aug. 29, 2016, the disclosures of which, including any materials incorporated by reference therein, are incorporated herein by reference in their entireties.

TECHNICAL FIELD

The present invention relates generally to the field of dental appliances, and more specifically relates to a therapeutic stretching device for the jaw and surrounding musculature.

BACKGROUND OF THE INVENTION

The temporomandibular joint and the closing muscles of the jaw connect the jaw to the temporal bones of the skull. Problems with this joint and the muscles associated with it are known as temporomandibular disorders ("TMD" or, more commonly, "TMJ"). The pain associated with TMJ can often be intense and long-lasting.

Although TMJ likely has multiple causes, one common cause is tightness in the closing muscles of the jaw. The normal range of these jaw-closing muscles is between 40 mm and 60 mm. However, because patients commonly clench and/or grind their teeth at night, as well as chew on hard objects or clench their teeth during the day, their closing muscles of the jaw become overly tight and cause the patient pain. The constant stress on these strong muscles causes them to tighten and reduce their range of motion, which in turn causes many TMJ symptoms.

In order to reduce, and hopefully, to eliminate their pain, patients need to stretch their jaw closing muscles. While the exact range of motion necessary will depend on each patient's range of motion, if a dental practitioner can assist a patient's jaw-closing muscles to achieve a value within the normal range, many times the patient's TMJ symptoms will subside. What is needed, therefore, is a dental device that can utilize step-wise incremental increases in jaw-opening to stretch and relax these muscles.

Various attempts have been made to address the above-mentioned issues. One such attempt can be seen in U.S. Patent Application Publication No. 2016/0228741, incorporated by reference in its entirety herein, which generally discloses a passive motion therapy device for stretching the jaw. While this disclosure does provide much-needed jaw strengthening, its design causes the device's bulk to rest relatively far out from the patient's jaw and its complicated, multi-piece design could confuse users.

Another attempt can be seen in U.S. Pat. No. 5,746,703, incorporated by reference in its entirety herein, which generally discloses a jaw-widening device intended to facilitate an increased range of motion for the closing muscles of the jaw. While this disclosure does presumably widen the patient's temporomandibular joint range of motion, its imprecise design fails to provide for specific intervals upon which a patient's maxillary teeth may rest.

Yet another attempt can be seen with respect to U.S. Patent Application Publication No. 20070089752, incorporated by reference in its entirety herein, which generally discloses a handheld device for stretching the temporomandibular muscles. While this disclosure does provide a simplified jaw-stretching system, this disclosure relies on two bite plates that can only move a patient's bottom and top rows of teeth away from each other vertically, rather than radially. As such, this disclosure fails to stretch a patient's jaw along the jaw's natural range of motion.

Additionally, some attempts are known commercially. However, such products are generally inadequate for this purpose. For example, some commercially available solutions comprise little more than a metal bar configured as a tiered wedge. Such products risk patient injury. Other products are overly complex, such as those requiring complicated sensors and long tube-like center pieces.

Thus, a need exists for a new dental device that a user can use to stretch the user's closing muscles of the jaw.

SUMMARY OF THE INVENTION

The present disclosure is directed to a dental device that provides for use to stretch a patient's closing muscles of the jaw, in addition to other therapeutic benefits.

Certain aspects, advantages, and novel features have been described and may be summarized in whole or in part in the present disclosure. Not all of the present invention's advantages may be achieved in accordance with any one particular embodiment. Hence, the disclosed subject matter may be embodied or carried out in a manner that achieves or optimizes one advantage or group of advantages without achieving all advantages as may be taught or suggested.

In certain embodiments, the present invention may comprise a wedge-shaped device having a stop configured to rest on a patient's lower teeth. Steps are formed on the device that allow a patient's upper teeth to rest on steps, which step based on the patient's range of motion. The steps may provide for a staircase-like series of steps on its outer side upon which a user may rest a user's maxillary teeth. As the user's jaw muscle relaxes with use of the present invention, it is contemplated that the user may place the user's maxillary teeth on the next step up in the series of steps. In so doing, the related muscles may stretch, and the patient may achieve a degree of relief from temporomandibular muscle pain.

In some embodiments, the steps are provided as a series of step-shaped increments, forming a shape much like a staircase on one side of the device. In some embodiments, the height of the steps (the "rise") may be 1 mm each and the length of the steps (the "run") may be 3 mm each.

In some embodiments, the present invention may additionally comprise a lengthening element. In such embodiments, the present invention may further comprise a lengthening element, such as, by way of illustration and not limitation, a screw, that may extend from an opposing side of the side in which the steps are formed. In some embodiments, the present invention may be configured such that twisting the lengthening element may cause the distance between the intermediate step element and the first side to expand. In some embodiments, the present invention may further comprise a ratcheting element, such that a user may cause the distance between the intermediate step element and the first side to expand by manipulating the ratchet element.

In some embodiments, the present invention may also comprise one or more sensors communicatively coupled to one or more processors and one or more battery sources. In such embodiments, the present invention may comprise that the one or more sensors may detect, and the one or more processors may wirelessly transmit, one or more elements of patient data to one or more additional devices, such as by way of illustration and not limitation, a mobile phone. By way of illustration and not limitation, such data may comprise a user's amount, intensity, duration, or other manner of use of the present invention. The present invention may further comprise a system and method stored and executable upon a mobile device that may interpret, re-transmit, or otherwise use the one or more data elements.

One or more of the above-disclosed embodiments, in addition to certain alternatives, are provided in further detail below with reference to the attached figures. The disclosed subject matter is not, however, limited to any particular embodiment disclosed.

BRIEF DESCRIPTION OF THE DRAWINGS

These and other features, aspects and advantages of the present invention will become better understood with regard to the following description, appended claims, and accompanying figures where:

DETAILED DESCRIPTION OF THE INVENTION

Figure 1:
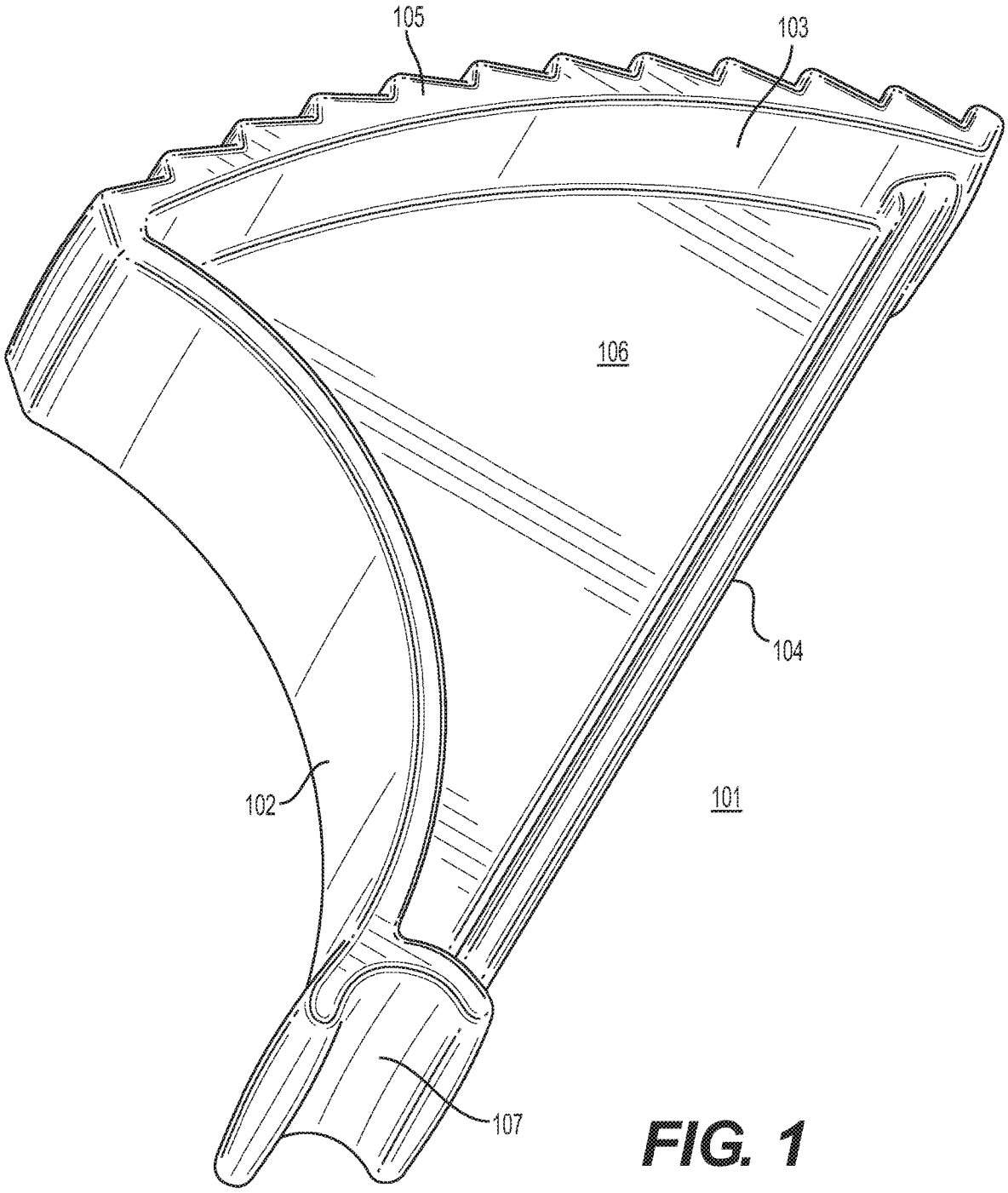
FIG. 1 shows a perspective view of a therapeutic stretching device for the jaw in accordance with an embodiment of the invention.
Figure 2:
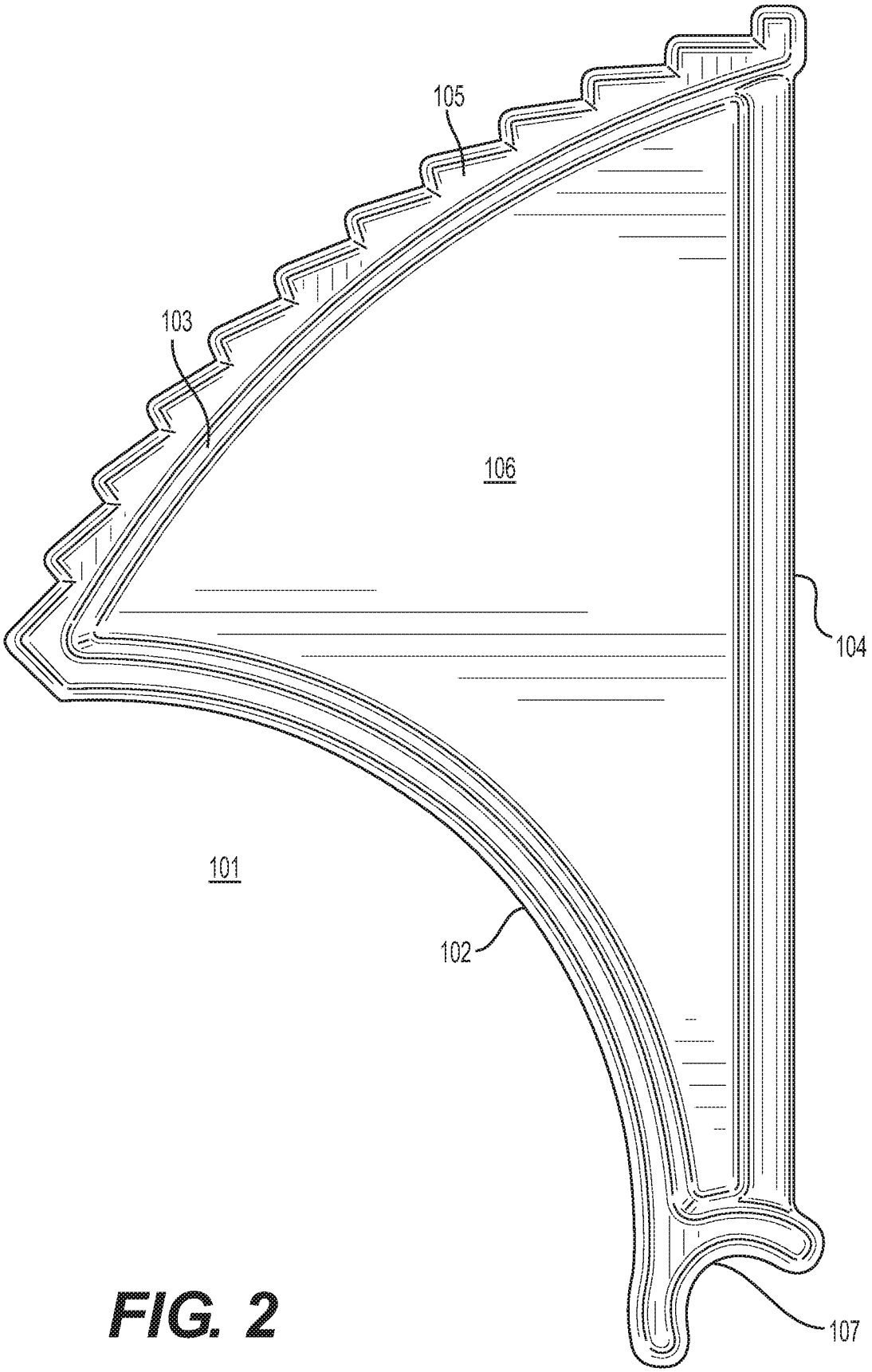
FIG. 2 shows a left-side view of a therapeutic stretching device for the jaw in accordance with an embodiment of the invention.
Figure 3:
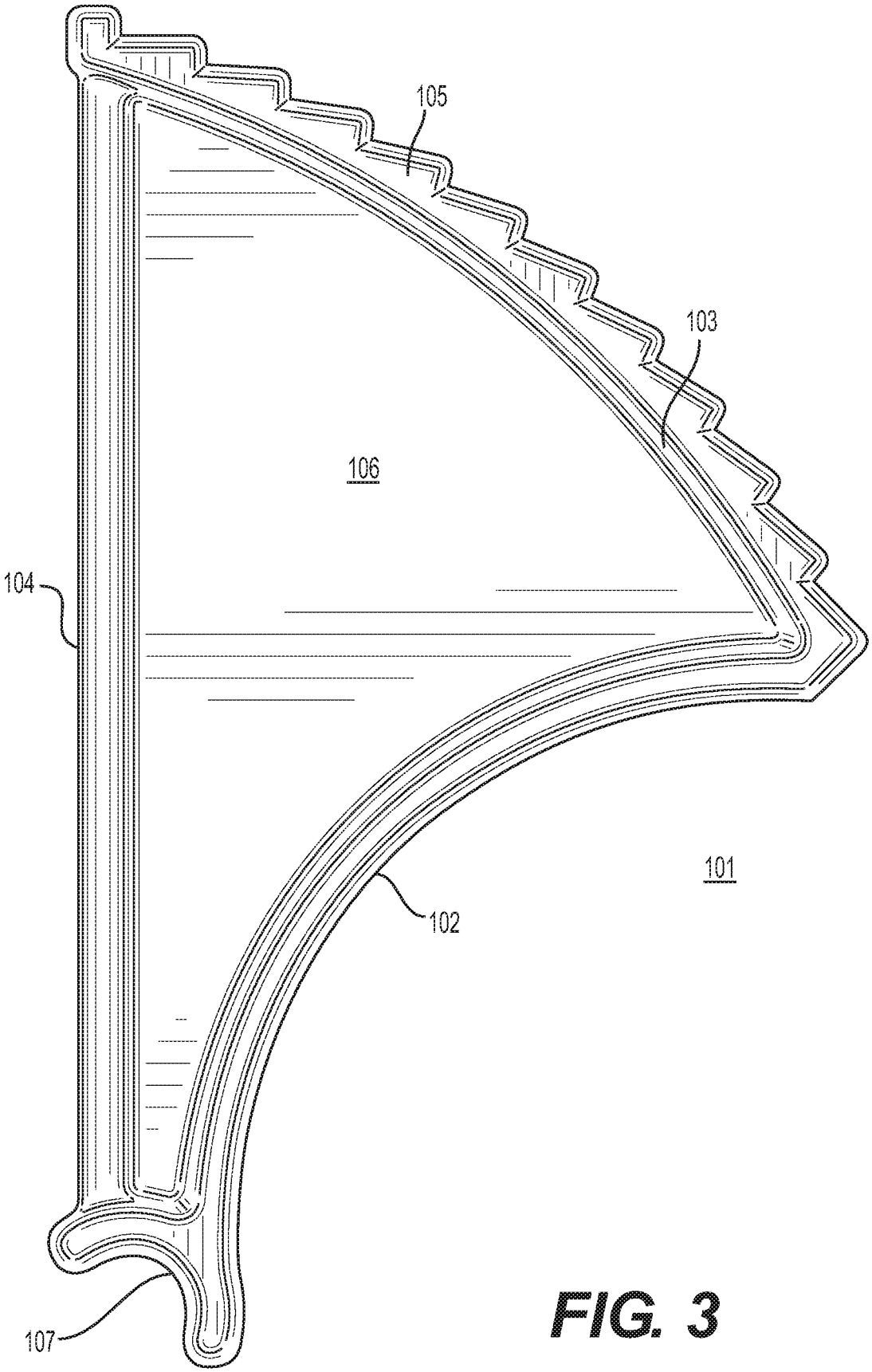
FIG. 3 shows a right-side view of a therapeutic stretching device for the jaw in accordance with an embodiment of the invention.
Figure 4:
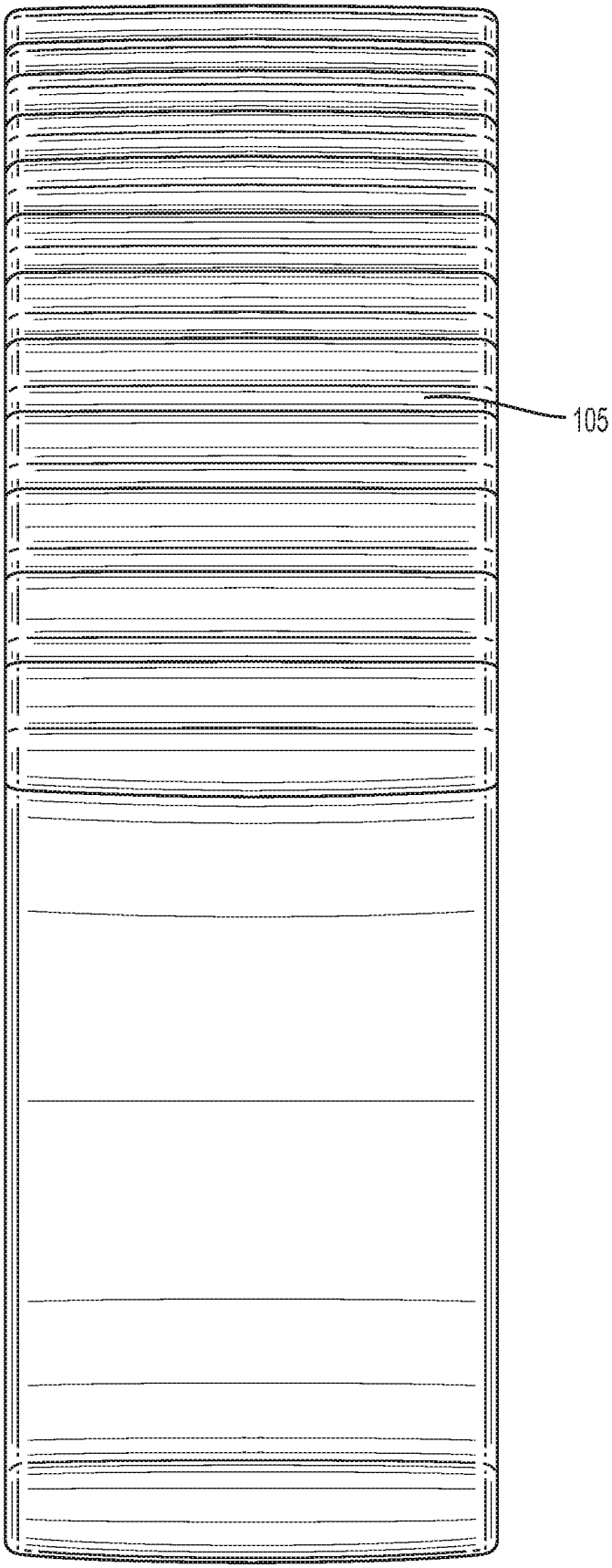
FIG. 4 shows a front view of a therapeutic stretching device for the jaw in accordance with an embodiment of the invention.

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

As used in this disclosure, except where the context requires otherwise, the term "comprise" and variations of the term, such as "comprising", "comprises" and "comprised" are not intended to exclude other additives, components, integers or steps. Additionally, in the following description, specific details are given to provide a thorough understanding of the embodiments. However, it will be understood by one of ordinary skill in the art that the embodiments may be practiced without these specific details. Well-known features, elements or techniques may not be shown in detail in order not to obscure the embodiments.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements. As will be understood by those with skill in the art, the actual dimensions and proportions of any embodiment or element of an embodiment disclosed in this disclosure will be determined by its intended use.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

FIG. 1 shows a perspective view of a therapeutic stretching device for the jaw in accordance with an embodiment of the invention. In the exemplary embodiment depicted, a therapeutic stretching device for the jaw 101, first side 102, second side 103, third side 104, steps 105, center element 106, and stop 107 is generally shown.

In the embodiment depicted in FIG. 1, each of first side 102, second side 103, and third side 105 have inner and outer sides. Formed on an outer side of second side 103 are steps 105. Connected to inner sides of first, second and third sides 102, 103 and 104 is a center element 106, which provides structural integrity to the device 101. In some embodiments, center element 106 may be substantially flat, and may be configured to fill in the area between first side 102, second side 103, and third side 104. This area may be used to provide identifying information about the device to a user.

Additionally, first side 102, second side 103, and third side 104 each have first and second ends. First end of first side 102 is connected to second end of third side 104, second end of first side 102 is connected to first end of second side 103, second end of second side 103 is connected to first end of third side 104. Additionally, first side 102, second side 103, and third side 104 each have a left side and a right side.

Formed at the intersection of the first end of first side 102 and second end of third side 104 is stop 107. Stop 107 can be arcuate to fit over a user's tooth or teeth.

In some embodiments, first side 102 may be arcuate. In some embodiments, such as depicted in FIG. 1, the inner side of first side 102 and the outer side of first side 102 may be arcuate.

Remaining with FIG. 1, in some embodiments, at least one side of second side 103 may be arcuate. In some embodiments, such as depicted in FIG. 1, the inner side of second side 103 and the outer side of second side 103 may be arcuate.

With respect to steps 104, in some embodiments, such as may be perceived in FIG. 1, the inner side of steps 104 may be arcuate. In other embodiments, the inner side of 104 may be straight. Furthermore, in some embodiments, the height (the "rise") of the steps on the outer side of steps 104 may be 1 mm each, but such portions may be other heights. Relatedly, in some embodiments, the length (the "run") of the steps on the outer side of steps 104 may be 3 mm each, but such portions may be of any length. As well, it is contemplated that, in some embodiments, the present invention may provide for one step portion, two step portions, or three or more step portions. It is contemplated that, as used herein, any configuration of the outer side of steps 104 having two or more step portions may be considered having a staircase shape or a staircase configuration. Numbers may be placed on each step to indicate the respective height of the step and/or amount of stretch obtained at that step.

Figure 5:
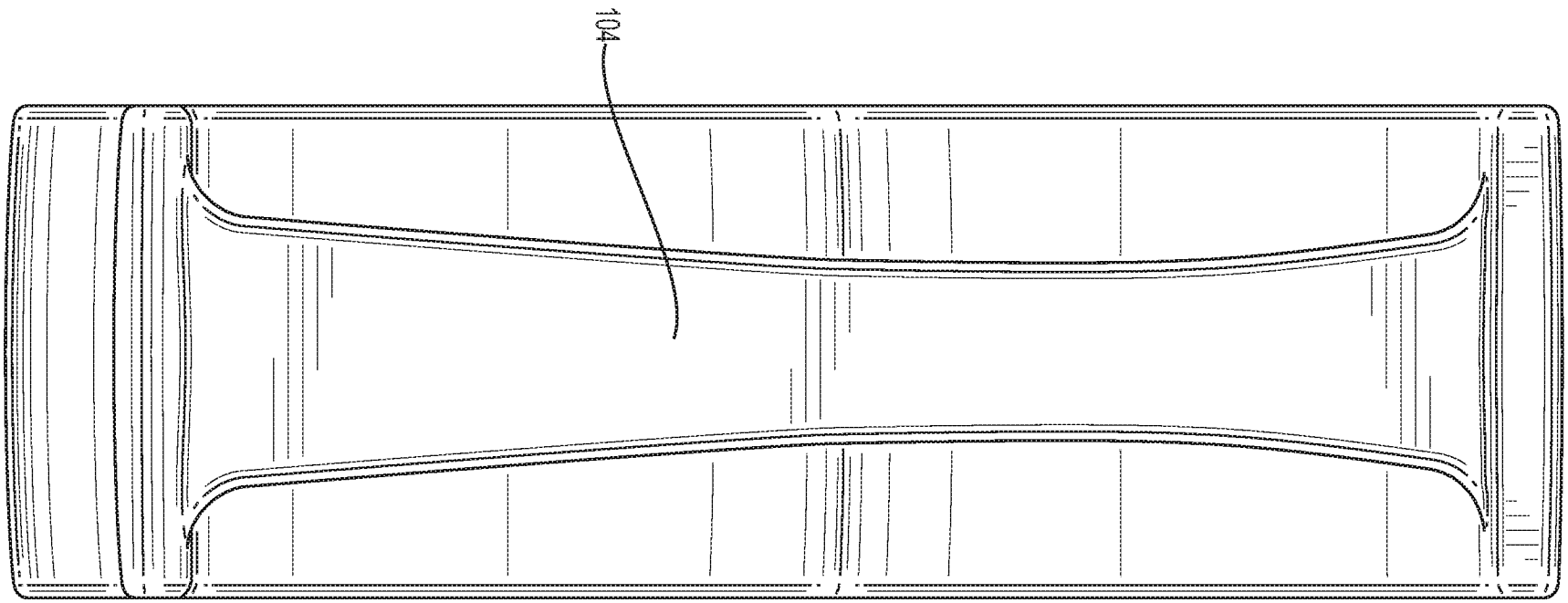
FIG. 5 shows a rear view of a therapeutic stretching device for the jaw in accordance with an embodiment of the invention.
Figure 6:
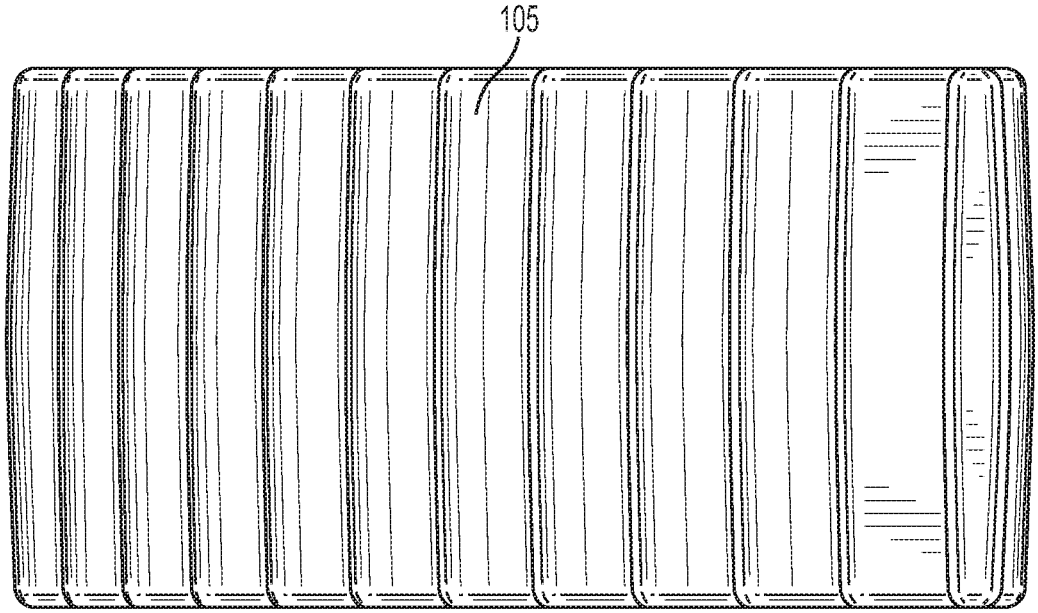
FIG. 6 shows a top view of a therapeutic stretching device for the jaw in accordance with an embodiment of the invention.
Figure 7:
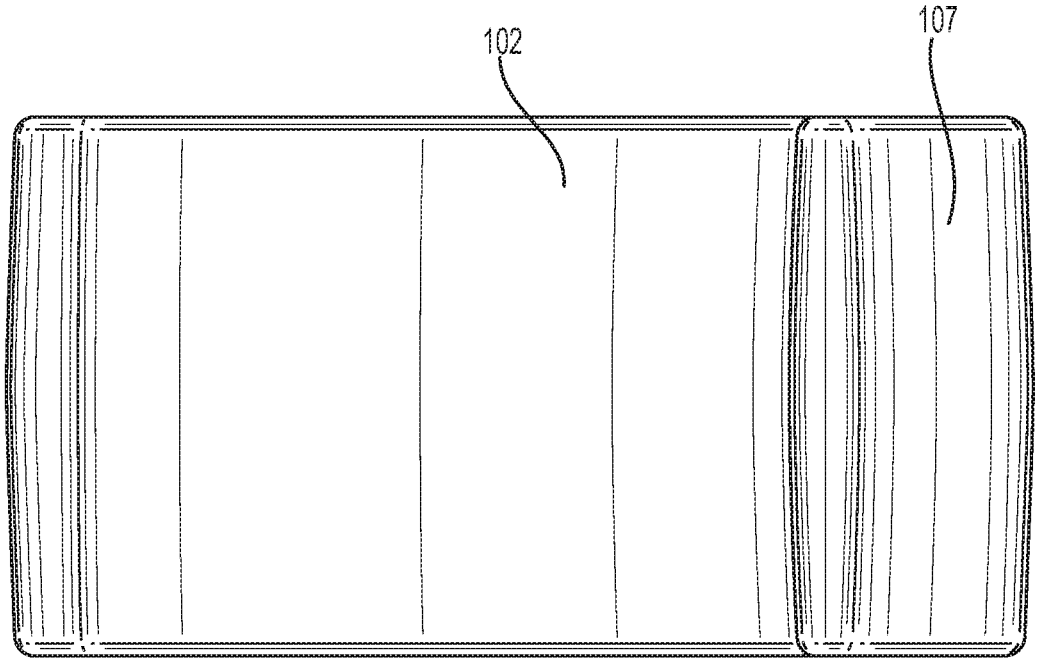
FIG. 7 shows a bottom view of a therapeutic stretching device for the jaw in accordance with an embodiment of the invention.
Figure 8:
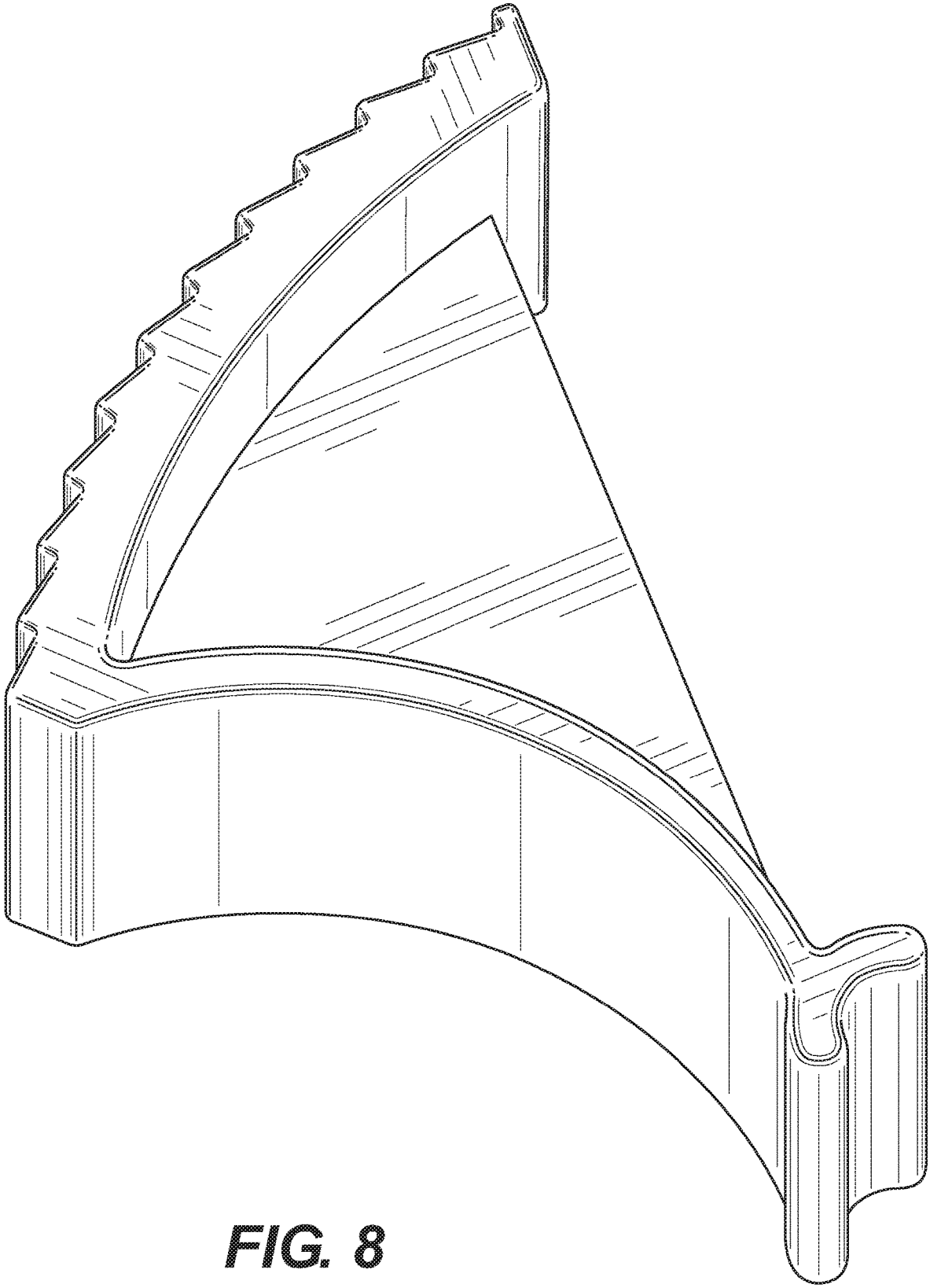
FIG. 8 shows a perspective view of a therapeutic stretching device for the jaw in accordance with a second embodiment of the invention.
Figure 9:
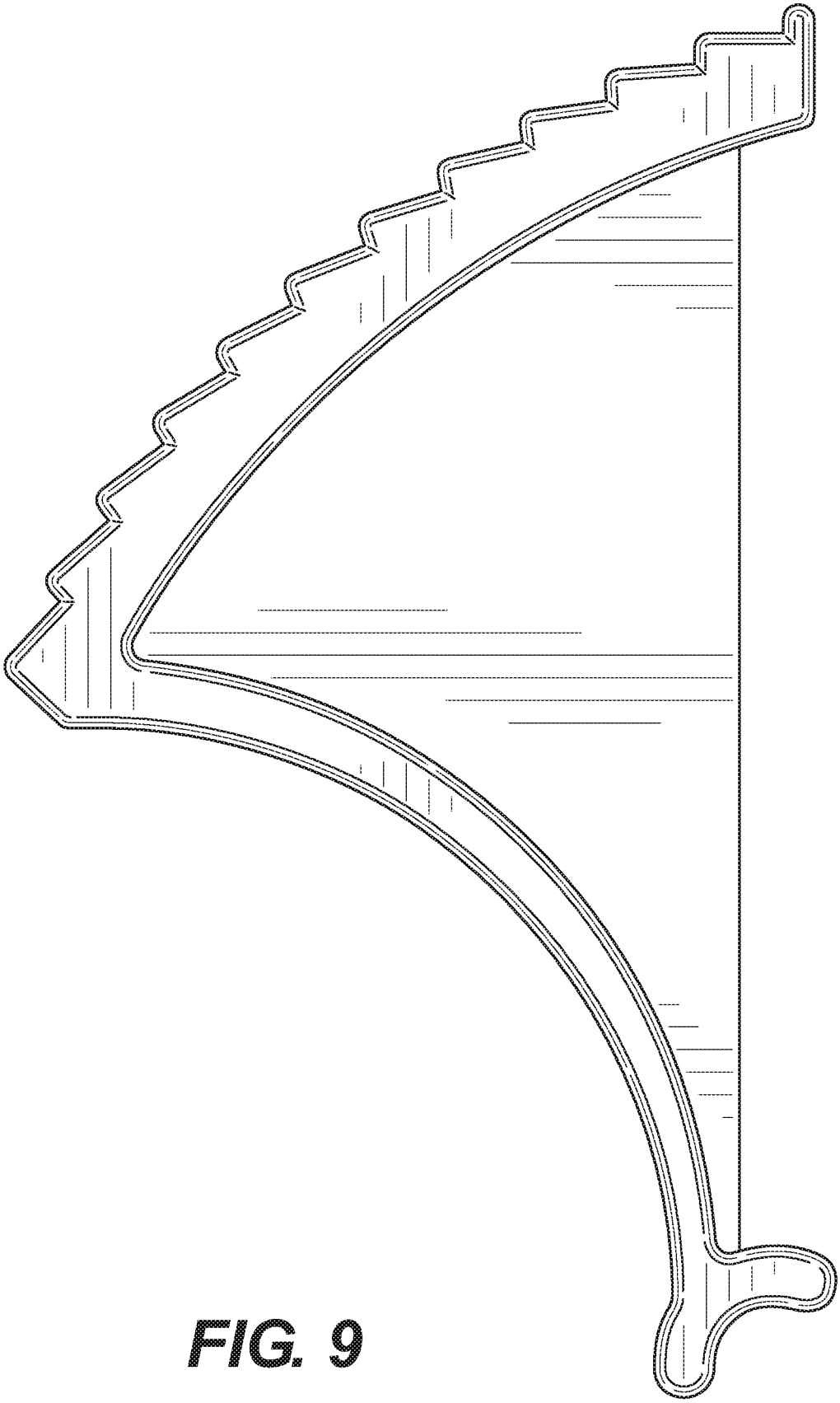
FIG. 9 shows a left-side view of a therapeutic stretching device for the jaw in accordance with a second embodiment of the invention.
Figure 10:
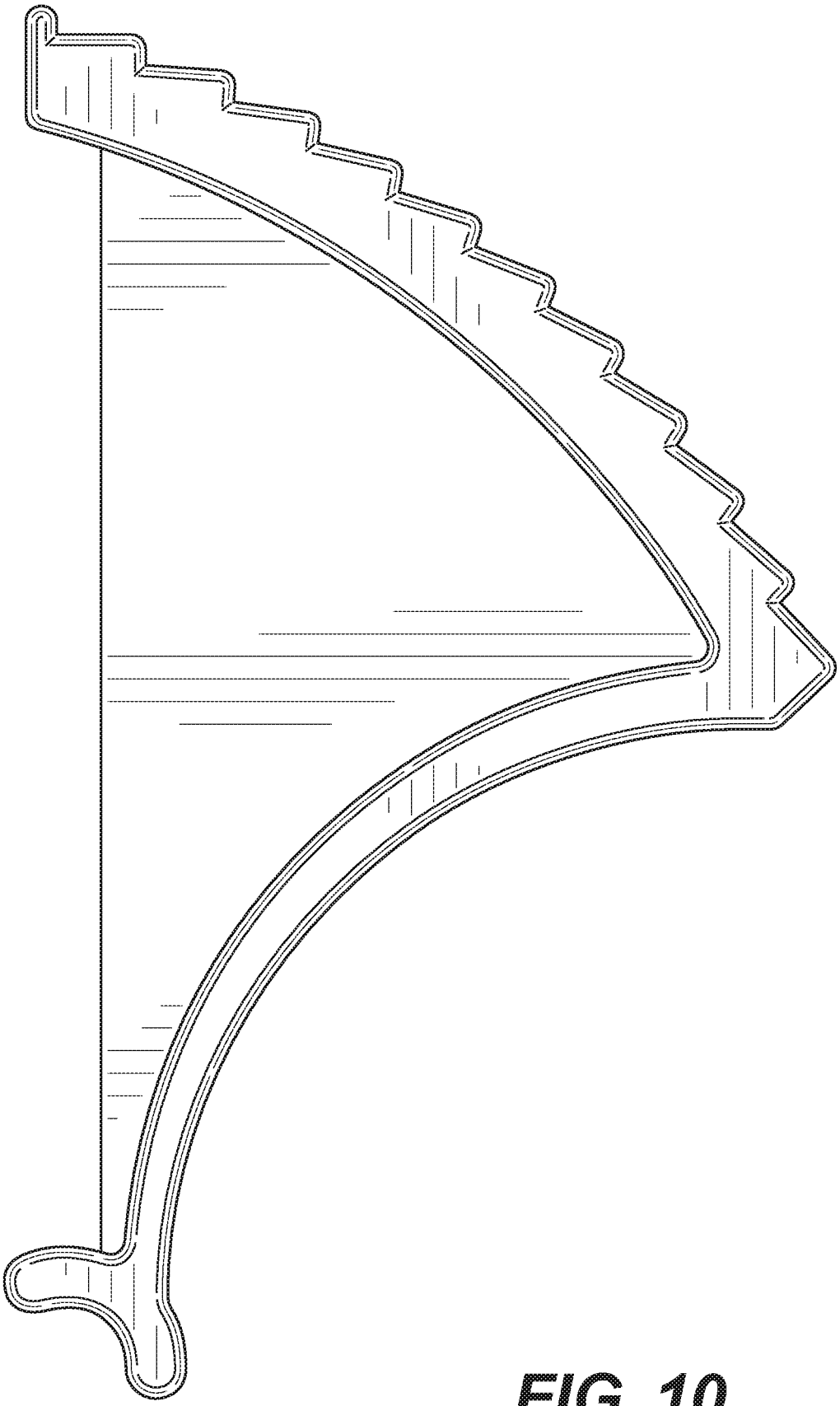
FIG. 10 shows a right-side view of a therapeutic stretching device for the jaw in accordance with a second embodiment of the invention.
Figure 11:
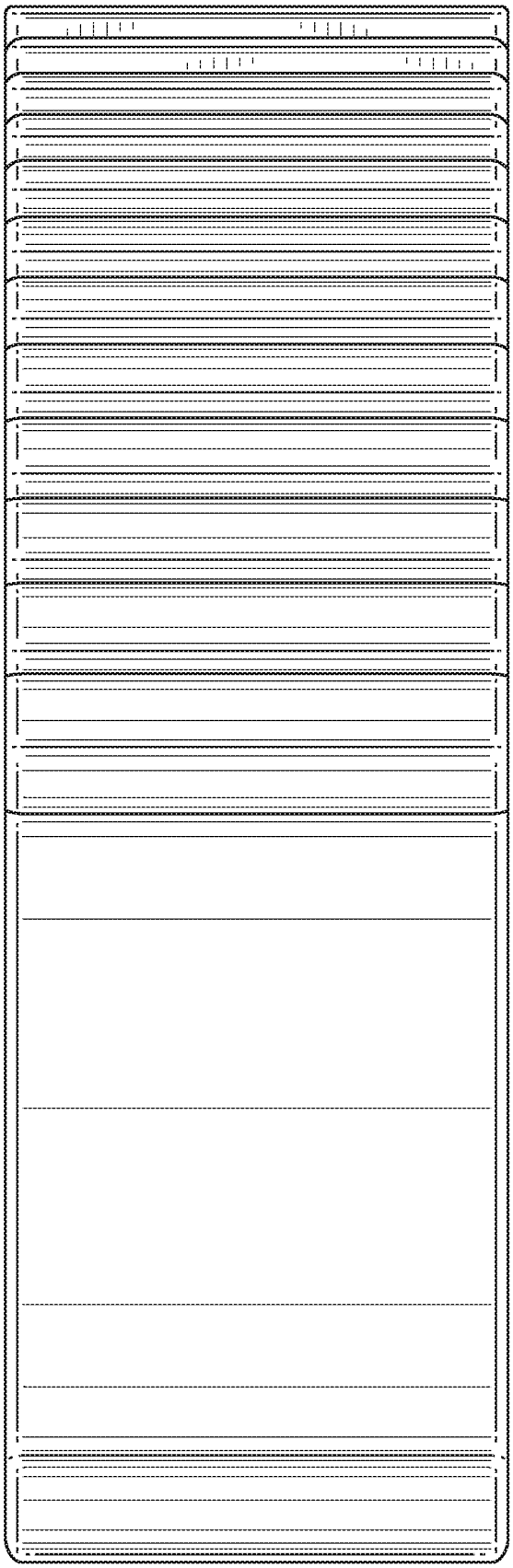
FIG. 11 shows a front view of a therapeutic stretching device for the jaw in accordance with a second embodiment of the invention.

Continuing with FIG. 1, in some embodiments, third side 105 may be substantially straight. In some embodiments, the inner side of third side 105 and the outer side of third side 105 may be of varying lengths or of different shapes. In some embodiments, such as depicted in FIG. 1, both inner and outer sides of third side 104 taper at a center thereof, creating an "I" shape. (See FIG. 5.)

Generally, device 101 may be of varying sizes to accommodate different users with different-sized mouth and teeth. The number of steps 105 formed on a device 101 can also vary.

Furthermore, in some embodiments, the thickness of center element 106 may be larger or smaller. Indeed, in some embodiments, it is contemplated that the thickness of center element 106 may be such that either the right side of center element 106, the left side of center element 106, or both the left and the right sides of center element 106 may be flush or substantially coplanar with one or more of the left side, the right side, or both sides of one or more of first side 102, second side 103, and third side 104.

In some embodiments, the present invention may provide for at least one lengthening element (not shown in FIGS), such as by way of illustration and not limitation a screw, that may extend partially or fully within device 101. In some embodiments, lengthening element may be located partially or entirely within center element 106. In some embodiments, lengthening element may be located partially or entirely on one or more sides of center element 106. In some embodiments, the present invention may further provide for a twist-adjustment element (not shown), also contemplated to be connected to the center element, that may be configured such that twisting the twist-adjustment element may cause the lengthening element, and hence the distance between stop 107 and steps 105, to expand or contract. In some embodiments, the present invention may further provide for a ratchet element (not shown), also contemplated to be connected to the center element, that may be configured such that manipulating the ratchet element may cause the lengthening element, and hence the distance between stop 107 and steps 105, to expand or contract.

In some embodiments, the present invention may provide for one or more sensors, one or more processors, one or more battery sources, one or more data transmission elements, as well as, optionally, one or more additional elements known in the art to detect data elements and transmit data elements to one or more other devices. In some embodiments any of the one or more of the one or more sensors, one or more processors, one or more battery elements, and one or more data transmission elements may be communicatively coupled with one or more sensors, one or more processors, one or more battery elements, one or more data transmission elements, or one or more additional elements.

FIGS. 2-7 show various views of the therapeutic stretching device of FIG. 1.

Figure 12:
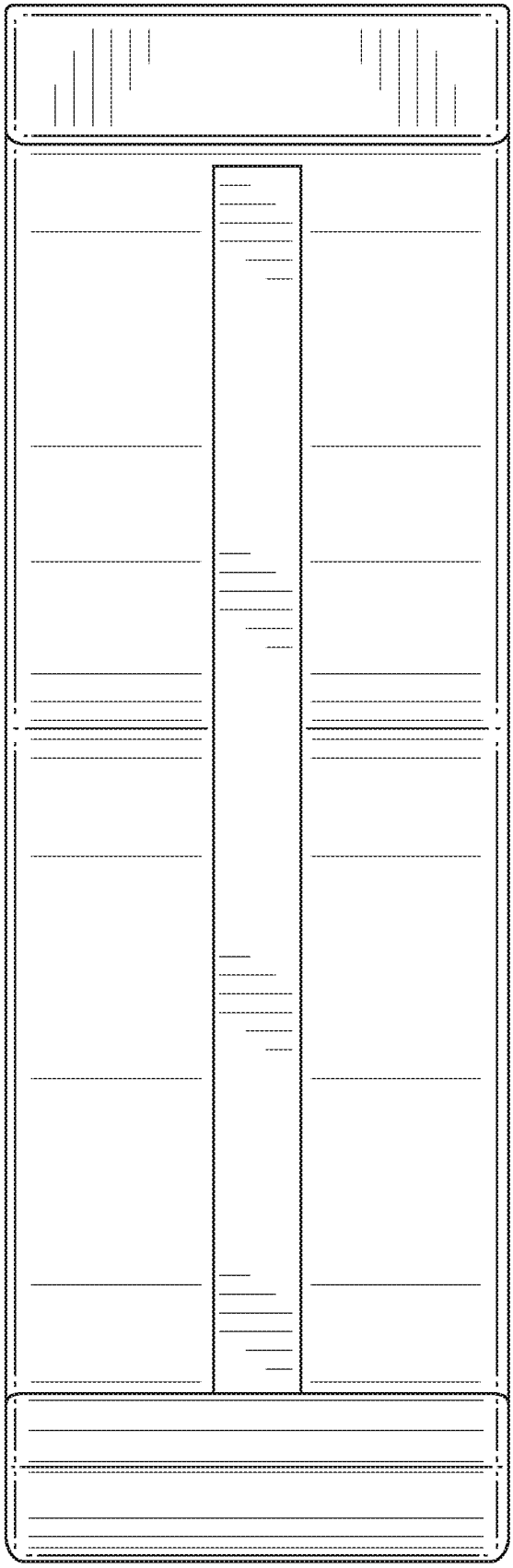
FIG. 12 shows a rear view of a therapeutic stretching device for the jaw in accordance with a second embodiment of the invention.
Figure 13:
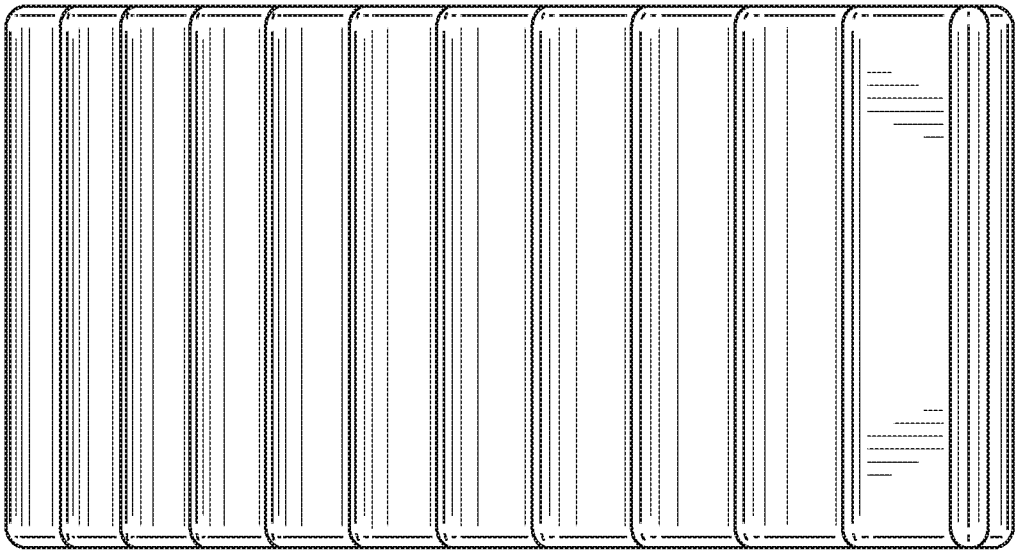
FIG. 13 shows a top view of a therapeutic stretching device for the jaw in accordance with a second embodiment of the invention.
Figure 14:
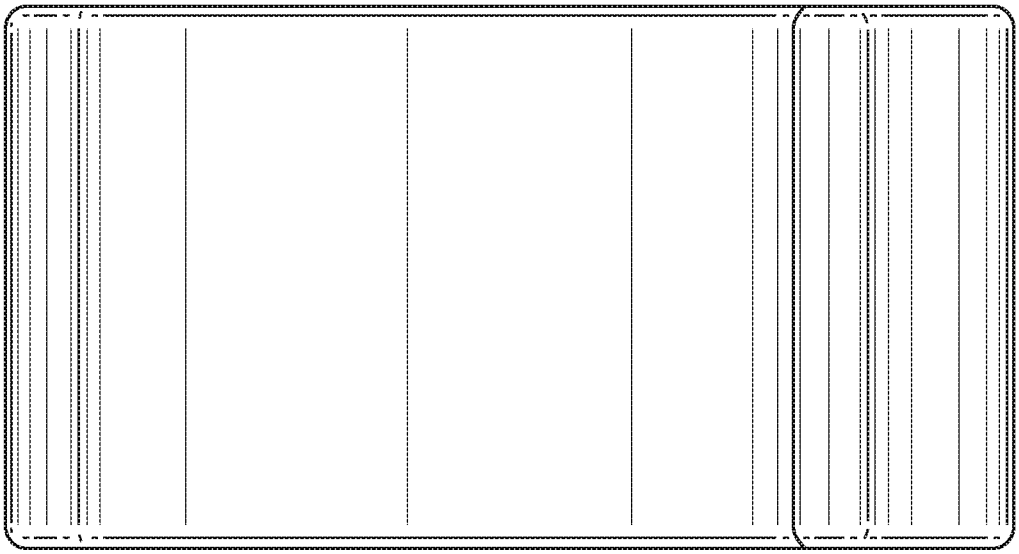
FIG. 14 shows a bottom view of a therapeutic stretching device for the jaw in accordance with a second embodiment of the invention.

FIG. 8-14 show an alternate embodiment of another exemplary therapeutic stretching device in accordance with the present invention. In this embodiment, third side has a more uniform beam as shown in FIG. 12.

Figure 15:
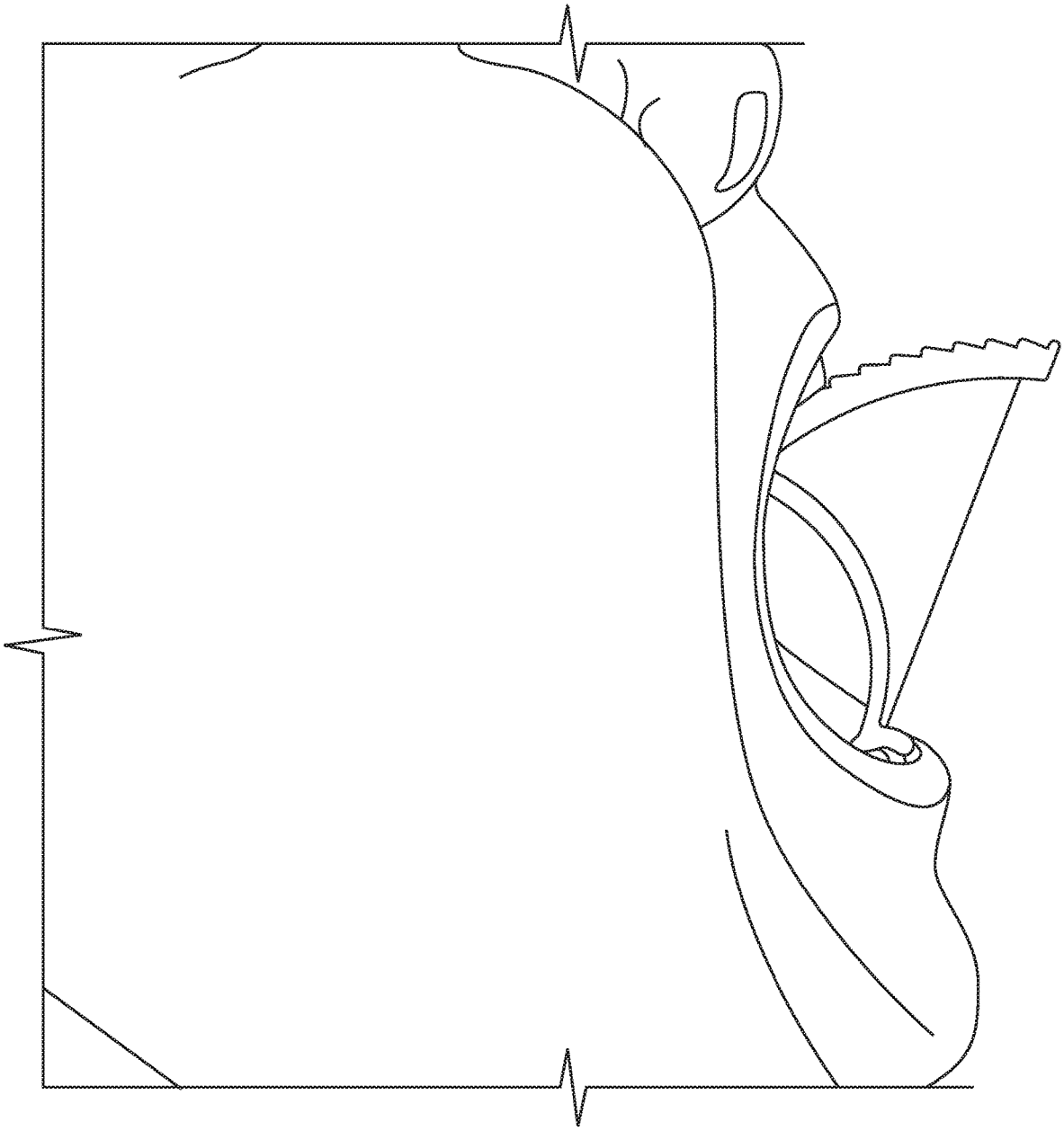
FIG. 15 shows the device in use by a user.

FIG. 15 shows a user with the device inserted in the user's mouth.

The drawings and associated descriptions provided herein are intended to illustrate potential embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

Throughout the drawings, reference numbers are re-used to indicate correspondence between referenced elements. In addition, the first digit of each reference number indicates the figure where the element first appears.

Although the present invention has been described with a degree of particularity, it is understood that the present disclosure has been made by way of example and that other versions are possible. As various changes could be made in the above description without departing from the scope of the invention, it is intended that all matter contained in the above description or shown in the accompanying drawings shall be illustrative and not used in a limiting sense. The spirit and scope of the appended claims should not be limited to the description of the preferred versions contained in this disclosure.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" or "step" clause as specified in 35 U.S.C. § 112.

The invention claimed is:

1. A therapeutic stretching device for a jaw of a user comprising:

first, second and third sides, each of said first, second and third sides connected to each other to create a wedge;

said first side having an arcuate shape and curved toward said third side;

said second side having an inner side and an outer side and a plurality of steps formed on said outer side thereof; and a stop formed where said first and third sides meet;

wherein said stop is U-shaped and configured to allow the stop to fit over the user's teeth.

2. The therapeutic stretching device of claim 1, wherein said third side is tapered at a center thereof.

3. The therapeutic stretching device of claim 1, wherein said plurality of steps is at least five steps.

4. The therapeutic stretching device of claim 1, wherein said second side is arcuate.

5. A therapeutic stretching device for a jaw of a user comprising:

first, second and third sides, each of said first, second and third sides connected to each other to create a wedge shape;

said second side having an inner and an outer side and a plurality of steps formed on said outer side thereof; and a curved stop formed where said first and third sides meet;

wherein said curved stop is U-shaped and configured to allow to fit over the user's teeth.

6. The therapeutic stretching device of claim 5, wherein said third side is tapered at a center thereof.

7. The therapeutic stretching device of claim 5, wherein said plurality of steps is at least five steps.

8. The therapeutic stretching device of claim 5, wherein said second side is arcuate.

9. A method of stretching a jaw of a user comprising the steps of:

(1) inserting a therapeutic stretching device for the jaw comprising:

first, second and third sides, each of said first, second and third sides connected to each other to create a wedge shape;

said second side having an inner and outer side and a plurality of steps formed on said outer side thereof; and a stop formed where said first and third sides meet;

(2) placing one set of either upper or lower teeth on one of said plurality of steps;

(3) placing the other of said one set of either upper or lower teeth on said stop; and (4) leaving said therapeutic stretching device in place for a specified period of time.

10. The method of claim 9, wherein the therapeutic stretching device has a processor capable of wirelessly transmitting data to another device.

* * * * *